US008291633B1

(12) United States Patent
Hass et al.

(10) Patent No.: US 8,291,633 B1
(45) Date of Patent: Oct. 23, 2012

(54) BIPOD FOR LIGHT-WEIGHT MACHINE GUN

(75) Inventors: Kevin M. Hass, Leesville, SC (US); Robert Wayne Sewell, Chapin, SC (US); Edward P. Schmitter, Eastover, SC (US)

(73) Assignee: FN Manufacturing, LLC, Columbia, SC (US)

( * ) Notice: Subject to any disclaimer, the term of this patent is extended or adjusted under 35 U.S.C. 154(b) by 477 days.

(21) Appl. No.: 12/579,437

(22) Filed: Oct. 15, 2009

Related U.S. Application Data

(60) Provisional application No. 61/107,555, filed on Oct. 22, 2008.

(51) Int. Cl.
*F41C 27/00* (2006.01)

(52) U.S. Cl. ..... 42/94; 42/72; 89/37.03; 89/37.04

(58) Field of Classification Search ..... 42/94, 85, 42/72; 248/168, 169; 89/37, 37.043
See application file for complete search history.

(56) References Cited

U.S. PATENT DOCUMENTS

| | | | | | |
|---|---|---|---|---|---|
| 1,524,973 | A * | 2/1925 | Hazelton | 42/94 |
| 1,890,423 | A * | 12/1932 | Teagarden | 42/94 |
| 2,436,349 | A * | 2/1948 | Adams | 42/94 |
| 2,807,904 | A * | 10/1957 | Kreske | 42/94 |
| 2,919,093 | A * | 12/1959 | Mooney | 248/168 |
| 3,235,997 | A * | 2/1966 | Stoner | 42/94 |
| 3,235,998 | A * | 2/1966 | Hadley | 42/94 |
| 3,745,879 | A * | 7/1973 | Asikainen et al. | 89/37.05 |
| 4,351,224 | A * | 9/1982 | Curtis | 89/37.04 |
| 4,397,112 | A * | 8/1983 | York | 42/94 |
| 4,470,216 | A * | 9/1984 | Harris | 42/85 |
| 4,580,483 | A * | 4/1986 | Garbini | 89/40.06 |
| 4,607,561 | A * | 8/1986 | Frimer | 89/37.04 |
| 4,625,620 | A * | 12/1986 | Harris | 89/37.04 |
| 4,776,124 | A * | 10/1988 | Clifton | 42/94 |
| 4,787,290 | A * | 11/1988 | Argon | 89/37.05 |
| 4,903,425 | A * | 2/1990 | Harris | 42/94 |
| 5,074,188 | A * | 12/1991 | Harris | 89/37.04 |
| 5,194,678 | A * | 3/1993 | Kramer | 42/94 |
| 5,410,835 | A * | 5/1995 | Vetter | 42/94 |
| 5,711,103 | A * | 1/1998 | Keng | 42/94 |
| 5,815,974 | A * | 10/1998 | Keng | 42/94 |
| 5,852,892 | A * | 12/1998 | Bilgeri et al. | 42/94 |
| 6,289,622 | B1 * | 9/2001 | Desch et al. | 42/94 |
| 6,487,807 | B1 * | 12/2002 | Kopman et al. | 42/94 |
| 6,517,133 | B2 * | 2/2003 | Seegmiller et al. | 294/139 |
| 6,763,627 | B1 * | 7/2004 | Kaempe | 42/94 |
| 6,829,857 | B1 * | 12/2004 | Houtsma | 42/94 |
| 6,843,015 | B2 * | 1/2005 | Sharp | 42/94 |
| 7,111,424 | B1 * | 9/2006 | Moody et al. | 42/72 |
| 7,401,431 | B2 * | 7/2008 | Pierce et al. | 42/94 |
| 7,409,791 | B2 * | 8/2008 | Moody et al. | 42/72 |
| 7,426,800 | B2 * | 9/2008 | Pierce et al. | 42/94 |

(Continued)

*Primary Examiner* — Michelle Clement
(74) *Attorney, Agent, or Firm* — Michael A. Mann; Nexsen Pruet, LLC

(57) ABSTRACT

A bipod for a light-weight machine gun is disclosed. The bipod has tubular telescoping legs with large ground-engaging feet that may be extended and retracted to discreet locking positions. The bipod has a spring-based system that allows a user to pivot the bipod legs about cylinder-in-a-cylinder pivot pins, either towards or away from the barrel muzzle with one hand, thus giving 180 degrees of travel. The bipod is attachable to a machine gun with a round yoke using a stepped screw and compression spring that assures yoke remains tightly secured to body, but rotatable for traversing, during extended use.

13 Claims, 6 Drawing Sheets

U.S. PATENT DOCUMENTS

| | | | | |
|---|---|---|---|---|
| 7,478,496 | B2 * | 1/2009 | Bender | 42/94 |
| 7,571,563 | B2 * | 8/2009 | Peterson | 42/94 |
| 7,614,174 | B1 * | 11/2009 | Beltz | 42/94 |
| 7,676,977 | B1 * | 3/2010 | Cahill et al. | 42/94 |
| 7,743,545 | B1 * | 6/2010 | Moody et al. | 42/94 |
| 7,779,572 | B2 * | 8/2010 | Potterfield et al. | 42/94 |
| 7,793,454 | B1 * | 9/2010 | Beltz | 42/94 |
| 7,823,317 | B2 * | 11/2010 | Potterfield et al. | 42/94 |
| 7,861,452 | B2 * | 1/2011 | Moody et al. | 42/94 |
| 7,909,301 | B2 * | 3/2011 | Faifer | 248/440.1 |
| 7,946,070 | B1 * | 5/2011 | Elhart | 42/94 |
| 7,946,071 | B2 * | 5/2011 | Cauley | 42/94 |
| 7,954,272 | B2 * | 6/2011 | Potterfield et al. | 42/94 |
| 2005/0241206 | A1 * | 11/2005 | Teetzel et al. | 42/72 |
| 2006/0248774 | A1 * | 11/2006 | Pierce et al. | 42/94 |
| 2006/0277809 | A1 * | 12/2006 | Moody et al. | 42/72 |

* cited by examiner

BIPOD FOR LIGHT-WEIGHT MACHINE GUN

CROSS-REFERENCE TO RELATED APPLICATIONS

The priority benefit of U.S. provisional patent application 61/107,555, filed Oct. 22, 2008, which is incorporated herein in its entirety by reference, is claimed. This application is related to U.S. Pat. No. 6,763,627 issued to the present applicant Jul. 20, 2004, and which is incorporated herein in its entirety by reference.

BACKGROUND OF THE INVENTION

The present invention relates to firearms, and specifically to bipods for use with a light-weight machine gun. A machine gun is not a shoulder-fired weapon like a rifle. It may be fired from the hip but is best fired when supported at the muzzle end by a bipod or other structure. Machine guns are heavy, they become quite hot when fired, and the forces associated with rapid firing makes it difficult to maintain accurate targeting unless the muzzle end is properly supported.

A bipod has been a staple accessory for many military firearms since the beginning of firearm development. The bipod generally cradles the barrel of a firearm and has two legs that can be planted on the ground. The bipod provides stability and support for the weapon when fired, especially when fired in long bursts.

To be effective, a machine gun must be highly mobile and rapidly deployable. The light-weight machine gun with its bipod must be capable of being removed from one position, carried in a variety of transportation vehicles (e.g. personnel carriers, airplanes, open trucks, etc) to another position, and set up quickly, and the attached bipod should not interfere with that redeployment. A bipod must also meet other common military objectives such as low weight, ease of use, simple construction, low cost, and high durability.

The twentieth century advent of the light-weight machine gun and the mechanized military has led to a refinement in the state of the art of bipods. Far from just a simple inverted V, current bipods are more complicated devices that include telescoping legs, swivel mounts, and folding structures. For example, U.S. Pat. No. 4,351,224, issued to Curtis, teaches a pair of L-shaped channels that telescope and fold from a deployed position to a stowed position. This bipod only allows for one direction of leg travel and each leg must be folded individually. U.S. Pat. No. 4,625,620, issued to Harris, teaches a pair of telescoping tubular legs that are individually folded and adjusted. In U.S. Pat. No. 5,711,103, issued to Keng, a swivel mount is incorporated into a bipod that allows a gunner to aim the weapon while keeping the bipod stationary. Keng also teaches a pair of telescoping tubular legs that are frictionally locked.

The prior art of firearm bipods, while extensive, is not without shortcomings. Many of the designs have many parts. One significant drawback to the prior art is that the bipod legs must be deployed separately, i.e. the legs must be unfolded one at a time rather than with a single motion. This means the user must either make two separate motions, or must set the gun down and unfold the legs with both hands. The releasing mechanisms that allow the legs to telescope and fold, such as the one disclosed by Curtis, are often overly complex, unreliable, or create a device that is somewhat unwieldy when transported in a small vehicle. Many of the designs, such as the one employing tubular legs with frictional locks as disclosed by Keng, are not suitable for military applications because they are not suitable for combat; dirt or damage to the legs can interfere with the telescoping.

The bipod disclosed in related patent, U.S. Pat. No. 6,763,627, issued to Kaempe, while a significant improvement over the prior art, also suffers in the rugged environment of use. Certain parts loosen or break, such as the e-clip, or become clogged with dirt or sand making the deployment of the legs of the bipod difficult. Therefore, there remains a need for an improved bipod that will be more robust, and easier and quicker to use than prior art bipods.

SUMMARY OF THE INVENTION

Briefly recited and according to its major aspects, the present invention is a bipod for a firearm such as a light-weight machine gun in which the telescoping legs can be deployed with one hand. The present invention has two legs that are connected by spring-based system that allows the legs to be deployed from a stowed position by applying pressure to just one leg. The legs of the present bipod may be stored facing either towards the stock of the gun or towards the muzzle. Improved pivot pins made with a cylinder within a cylinder facilitate repeated pivoting the legs between a parallel orientation, such as when in the stored position, and a splayed orientation such as when in the deployed position.

When the legs are folded from the stored position to the deployed position, the spring-based system acts on the legs, causing them to deploy. The spring-based system is housed inside a body that supports a yoke cradling the barrel of the gun in such a way that the gun and its yoke can be rotated radially through a small angle with respect to the body allowing the barrel of the machine gun to traverse left and right without moving the deployed bipod legs. The yoke is held securely to the body so that despite extended and rough handling, the yoke remains freely rotatable.

Each leg can telescope incrementally between a minimum length and a maximum length, using spring-loaded buttons to lock the legs in place once the desired length is reached. However, because of the design of the buttons, the user can extend the legs simply by pulling on the end of the leg. The foot of each leg is large enough to provide firm footing on a variety of surfaces including softer surfaces such as mud and sand.

An important feature of the present invention is the improved security of the attachment of the yoke to the body. The use of a stepped screw with compression spring assures a firm hold between the two.

Another important feature is the larger feet of the telescoping legs. The larger feet are more than an inch and one half in diameter as opposed to less than an inch for better stability on softer ground.

Still another feature of the present invention is the use of pivot pins each comprising a pin assembly formed by placing a cylinder within a cylinder to allow the two legs to pivot with respect to the body. The pin assembly consists of an inner coiled cylinder captured by an outer slotted cylinder. The inner cylinder exerts and distributes spring pressure uniformly absorbing shock and vibration outwards against the slotted cylinder to increase strength and detention.

Other features and their advantages will be apparent to those skilled in the art of firearm accessory design and fabrication from a careful reading of the Detailed Description of Preferred Embodiments accompanied by the following drawings.

DETAILED DESCRIPTION OF PREFERRED EMBODIMENTS

The preferred embodiment of the present invention is a bipod with telescoping legs that can be deployed with one hand.

Figure 1:
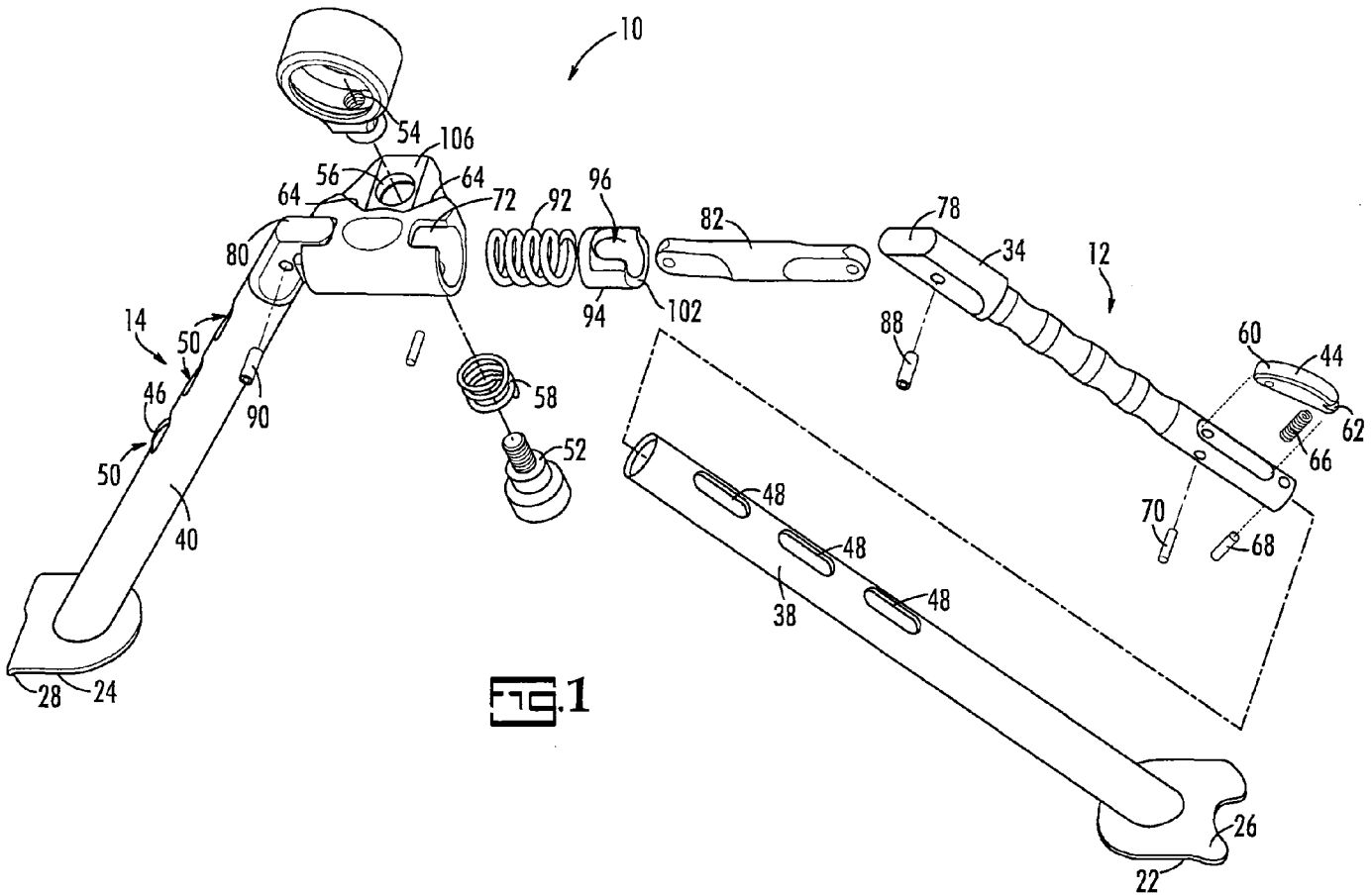
FIG. 1 is an exploded perspective view of the bipod in the deployed position
Figure 2:
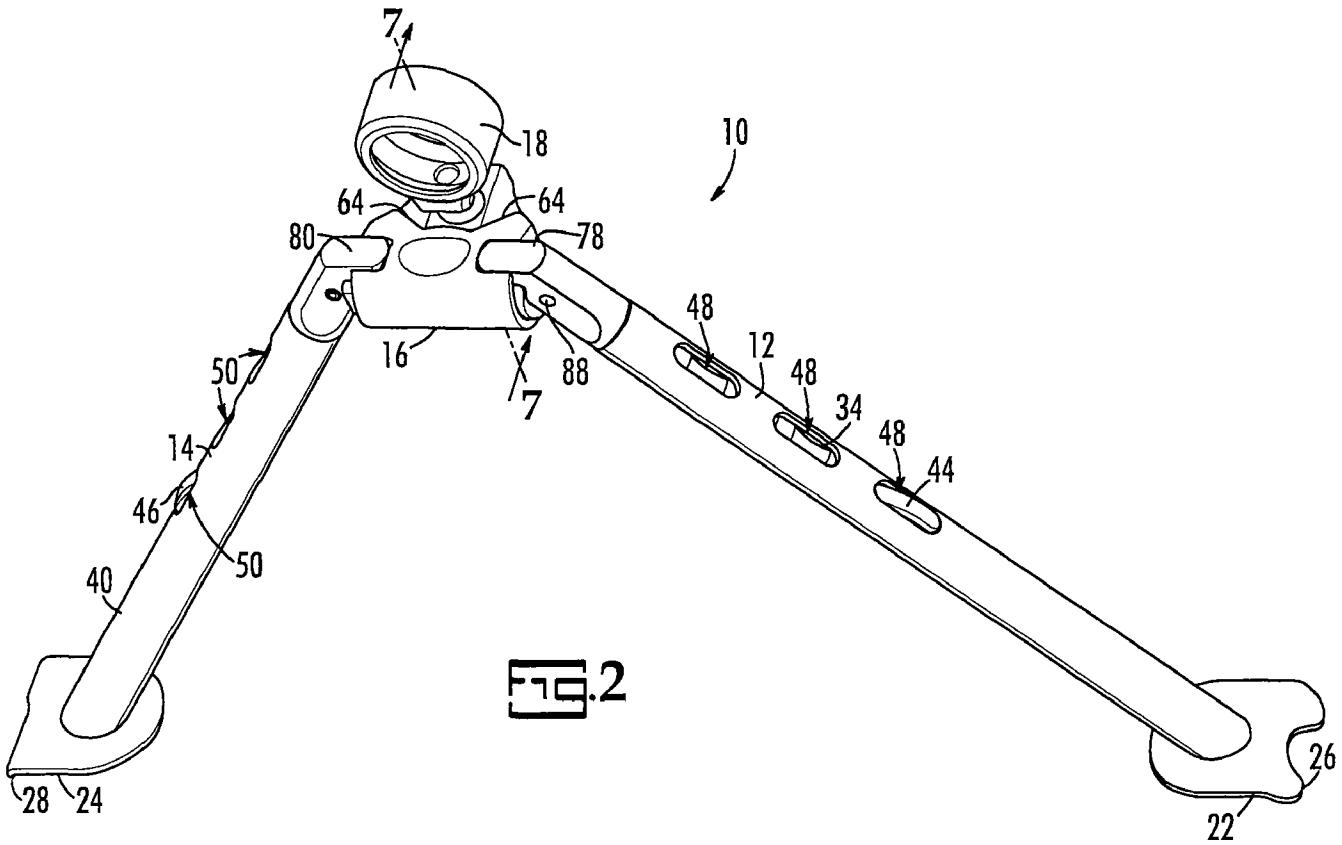
FIG. 2 is a perspective view of the assembled bipod in the deployed position.

Referring now to FIGS. 1 and 2, there are shown perspective exploded and assembled views of a preferred embodiment of the present invention, namely, a bipod for a lightweight machine gun generally indicated by reference number 10. Bipod 10 has two legs 12 and 14 that are attached to a body 16. Body 16 supports a yoke 18 that is dimensioned for encircling the barrel of a firearm such as a machine gun.

Bipod 10 is shown in the deployed configuration in FIGS. 1 and 2, with legs 12 and 14 splayed to provide stability. Each leg 12, 14, has a foot 22, 24, respectively, that engages the ground or other surface and is preferably formed to resist lateral movement. For secure footing, feet 22, 24, are large and have teeth 26, 28, respectively, to bite into a surface such as the ground or a sandbag, for example, and resist lateral movement. Feet are large to be useful on soft ground such as sand or mud, preferably, having at least approximately eleven square centimeters of ground-engaging area.

Figure 6:
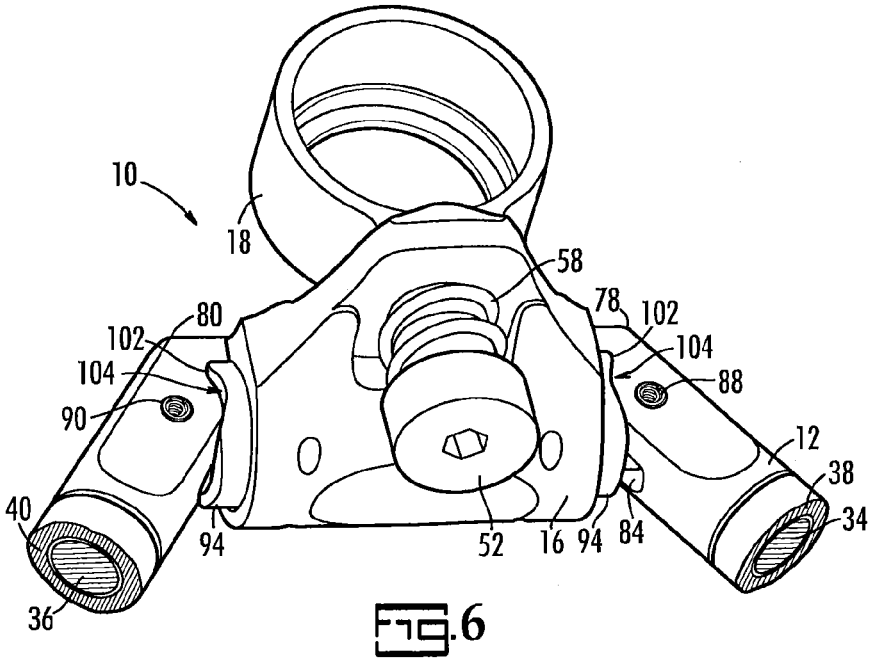
FIG. 6 is a detailed perspective bottom view of the bipod yoke.

Legs 12 and 14 are telescoping. Here, internal rods 34, 36, in tubes 38 and 40 provide this telescoping capability (only one rod, rod 34, is shown in FIGS. 1 and 2, but a second rod, rod 36 in tube 40, is identical to rod 34 in tube 38 and can be seen in cross section in FIG. 6) as tube 38 can receive rod 34 in its interior or be pulled axially with respect to rod 34 to lengthen leg 12. In particular rods 34, 36, have an outer diameter that is smaller than the inner diameter of tube 38 and tube 40 so that rods 34, 36, can slide axially in and out of tubes 38, 40. To secure rods 34, 36, with respect to tubes 38 and 40 at various relative positions, rods 34, 36 have spring-loaded, pivoting buttons 44, 46, and tubes 38 and 40 have a series of holes 48, 50, dimensioned to receive buttons 44, 46.

Figure 3A:
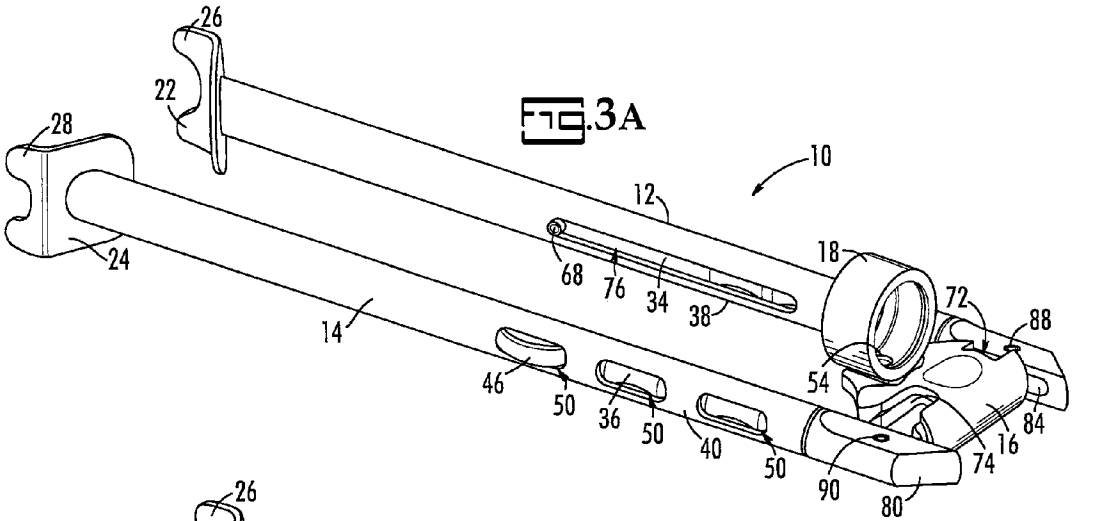
FIG. 3A is a top perspective view of the bipod in the stowed position and fully retracted.
Figure 3B:
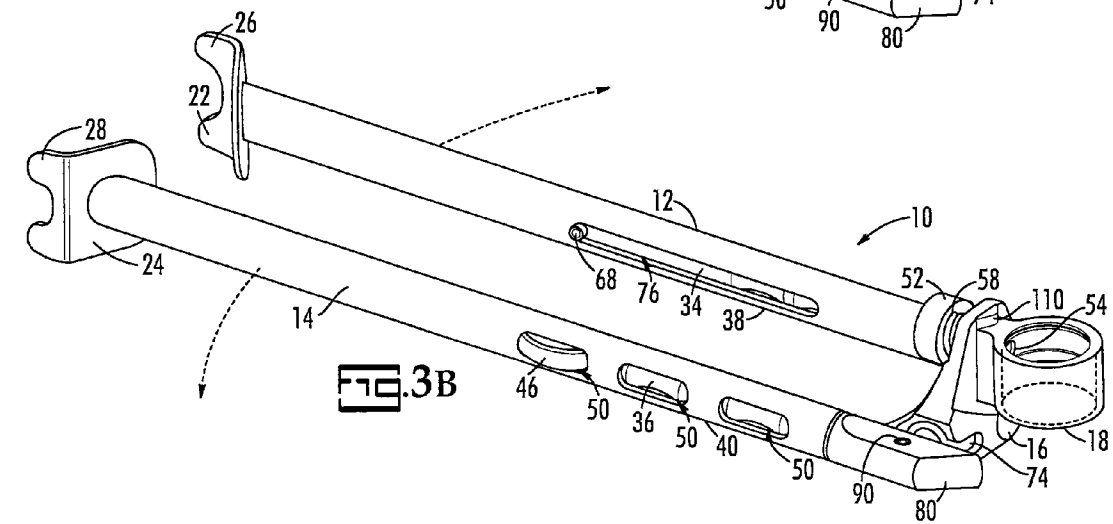
FIG. 3B is a perspective view of the bipod in a deployed position with the legs retracted and showing the direction in which the legs are urged by the spring-based system.
Figure 4:
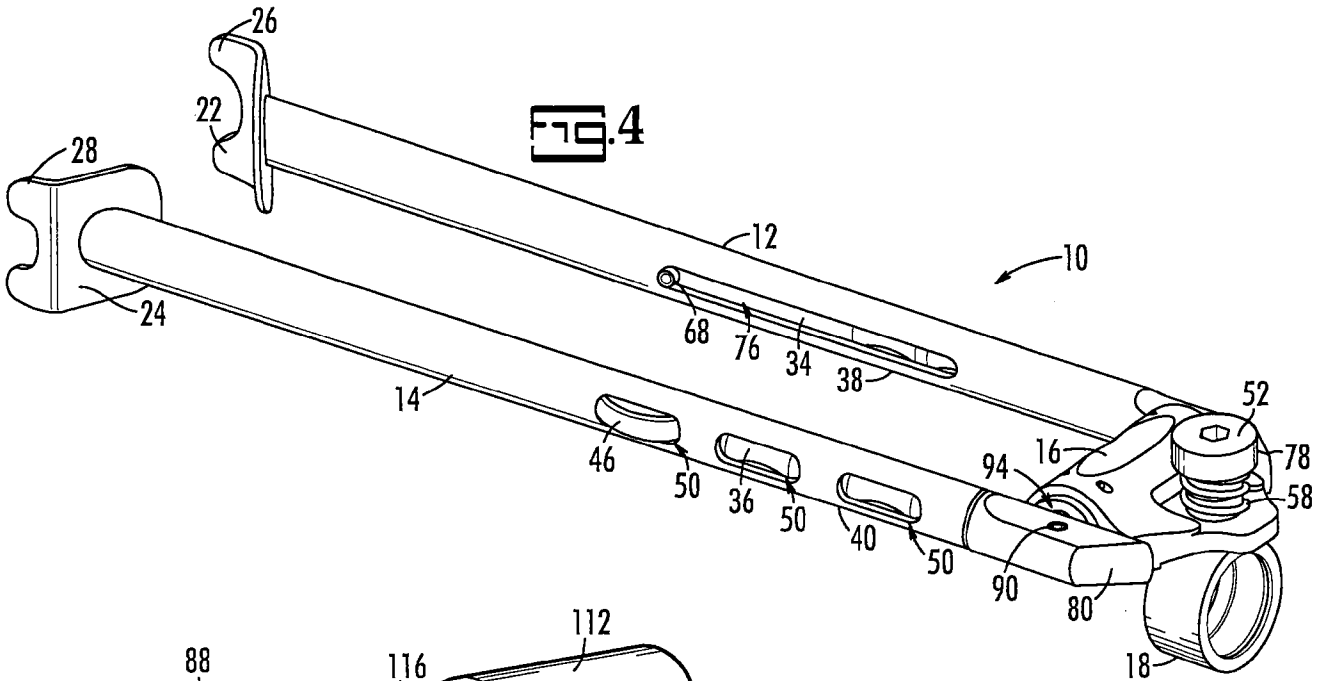
FIG. 4 is a perspective view of the bipod in an alternate stowed position with legs fully retracted.

Buttons 44, 46 will extend through holes 48, 50, when in rods 34, 36, bring buttons 44, 46, in registration with holes 48, 50, and of tubes 38, 40, and, by doing so, prevent telescopic collapse of legs 12, 14. However, because buttons 44, 46, are spring-loaded and curved, they permit telescopic extension of legs 12, 14, merely by pulling on feet 22, 24. In particular, buttons 44, 46, are oriented to have a major dimension parallel to the long axis of rods 34, 36. Each button 44, 46, has a first end 60 toward body 16 and a second end 62 oriented toward feet 22, 24 (only one button, button 44, is shown exploded in FIG. 1 but button 46 is identical to button 44). Second end 62 is urged outward or away from the axis of rod 34 by a spring 66. First end 60 of button 44 is free to pivot about a pin 70 oriented so that button 44 pivots about an axis perpendicular to the long dimension of rod 34. The surface of buttons 44, 46 is curved so that, when feet 22, 24 are pulled, buttons 44, 46 are crammed inward, toward rods 34, 36, but when feet 22, 24, are pushed toward body 16, buttons 44, 46, will catch on tubes 38, 40 at holes 48, 50, and cannot be pushed further unless pressed inward against rods 34, 36, held while feet 22, 24 are pushed sufficiently so that buttons 44, 46 go out of registration of holes 48, 50. The maximum and minimum extent of telescoping of rods 34, 36, respect to tubes 38, 40, is limited by stop pins 68 in slots 76 (FIGS. 3A, 3B, and 4). When stop pin 68 reaches the ends of slot 76, rods 34, 36, either completely telescopingly extended with respect to tubes 38, 40, or completely telescopingly retracted.

Referring to FIGS. 1, 2, 5-8, bipod 10 is attached to a firearm barrel by yoke 18, which is ring-shaped and strong enough to provide durable support for a machine gun barrel during extended operation, and preferably made of metal or metal alloy. Yoke 18 is attached to a body 16 by a stepped screw 52 inserted into a threaded hole 54 in yoke 18 through a hole 56 in body 16. A compression spring 58 is held between body 16 and screw 52 by placing spring 58 over screw 52 and attaching it to yoke 18 through hole 56 in body 16 and then screwing it into threaded hole 54 on yoke 18. See FIGS. 1 and 2. Screw 52 is further retained to threads 54 in yoke 18 by applying a thread locking compound. The addition of spring 58 maintains a flexible but pre-loaded interface that will allow yoke 18 to rotate in relation to body 16 but prevent wobble or vibration. It also provides a spring force to cause yoke 18 to return to its nominal position in a recess 106 formed on body (as best seen in FIG. 1) which helps to hold bipod 10 in line with the barrel of the gun when legs 12, 14 are folded. This rotation allows a gunner to pivot the barrel of the gun through a small angle in a plane lying perpendicular to a line bisecting the splayed legs 12, 14, so that the gun carried by yoke 18 has a field of fire without moving legs 12, 14. The pivot angle is defined by ledges 64 on body 16 (FIG. 5) that limit the rotation of yoke 18 within hole 56 of body 16.

Figure 7:
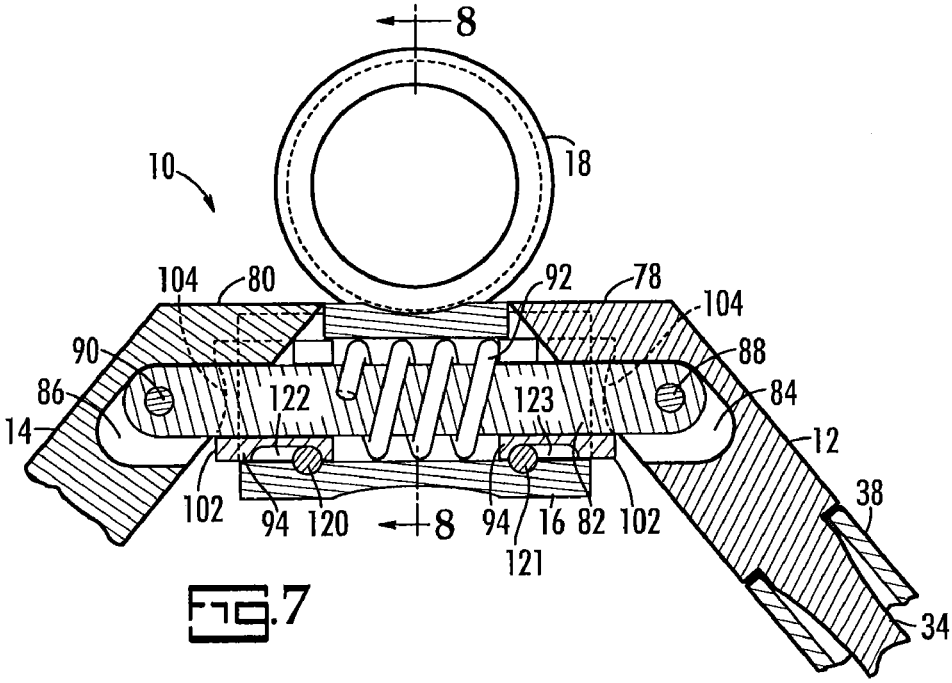
FIG. 7 is a cross-sectional view taken along lines 7-7 of FIG. 2.
Figure 8:
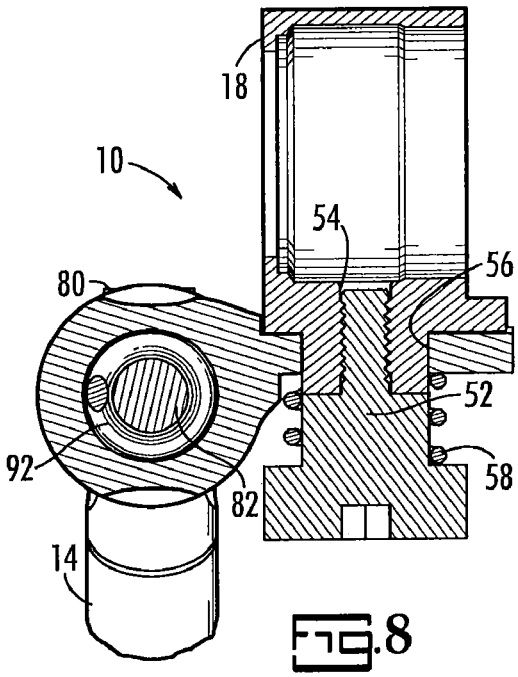
FIG. 8 is a cross-sectional view taken along lines 8-8 of FIG. 7.

Referring in particular to FIGS. 1 and 7, in the preferred embodiment, body 16 is essentially a hollow cylinder open at both ends and having cutout portions 72, 74 for receiving the tops 78, 80, of legs 12, 14, respectively, when legs 12, 14, are splayed. Legs 12, 14, are held securely to body 16 by a tie member 82 that is received within body 16 but which extends far enough beyond the ends of body 16 to allow it to be inserted into slots 84, 86, formed in tops 78, 80, of legs 12, 14, where it is secured with pins 88, 90.

Figure 5A:
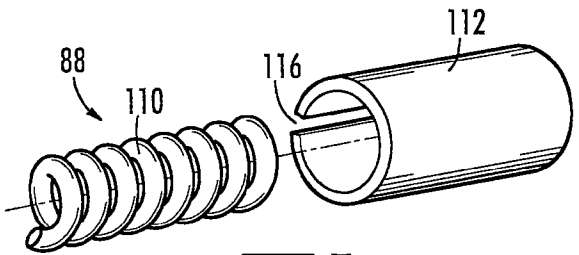
FIG. 5A is a detailed perspective of pin 88.

Pins 88, 90, may each be formed of a first cylinder 110 within a second cylinder 112, as best seen in FIG. 5A. First cylinder 110 is comprised of a coiled pin captured by outer slotted second cylinder 112 so that pins 88, 90 have the detention and strength required when in the holes formed in tie member 82 of legs 12, 14, that receive them. Thus, both first and second cylinders 110, 112, may act as springs and thereby provide smooth operation without wobble when legs 12, 14 are being deployed or stored, yet may avoid the need for a tight-tolerance that may become a problem in a difficult environment of use.

Inside body 16 is a compression spring 92 that encircles tie member 82 and is flanked by two plungers 94 (see FIG. 1 and FIG. 7) each of which is a hollow cylinder and has a cutout portion 96 for receiving tops 78, 80. Compression spring 92 resists the movement of plungers 94 toward each other and urges plungers 94 axially outward of body 16. Each plunger 94 is retained inside body 16 by pins 120, 121, which also limit each plunger 94's motion axially and rotationally through engagement with cuts 122, 123, formed in the bottom of each plunger 94. Cutout portion 96 is alignable with cutout portion 72 so that, when they are aligned, tops 78, 80, will be received in both of them as legs 12, 14, are rotated to a splayed position. When legs 12, 14, are splayed, feet 22, 24, rotate outwardly and tops 78, 80, rotate into cutout portions 72 and 96. The plungers 94 are prevented from rotating by the engagement of pins 120, 121, within cuts 122, 123.

Meanwhile plungers 94, urged by compression spring 92, in turn urge legs 12, 14, to the splayed, deployed position whenever legs 12, 14, are rotated from either of two stored positions. Plungers 94 accomplish this by the engagement of their leading edges 102 against legs 12, 14, at points just below where pins 88, 90, connect tie member 82 to legs 12, 14. By applying pressure at that point, leading edges 102 of plungers 94 cause legs 12, 14, to pivot about pins 88, 90, to move tops 78, 80, into cutout portions 72, 96, but only when legs 12, 14, have been rotated to the point where tops 78, 80 are able to be received within the aligned cutout portions 72, 74, i.e., to the position where they are to be deployed.

When legs 12, 14, have been rotated to either stowed position, tops 78, 80, will not be aligned for receipt into cutout portions 72, 96, and no rotation of legs 12, 14, can take place. In fact, when bipod 10 is in either stored position, leading edge 102 of plunger 94 will be engaging legs 12, 14, both above and below pins 88, 90 so no rotation will take place. Preferably, leading edge 102 of each plunger 94 has a pair of concave curves 104 formed on it (best seen in FIGS. 5, 6, and 7) so that legs 12, 14, are preferentially urged into the two stored positions (which will be described in more detail below).

FIGS. 3A, 3B, and 4 illustrate the three positions of bipod 10. FIG. 3A shows bipod in a stored position with the axis of yoke 18 parallel to the axes of legs 12, 14. When mounted onto the barrel of a machine gun or other gun in the configuration shown in FIG. 3A with barrel pointed to the right, legs 12, 14, extend rearward relative to the muzzle end of the barrel and aligned parallel to the barrel.

Figure 5:
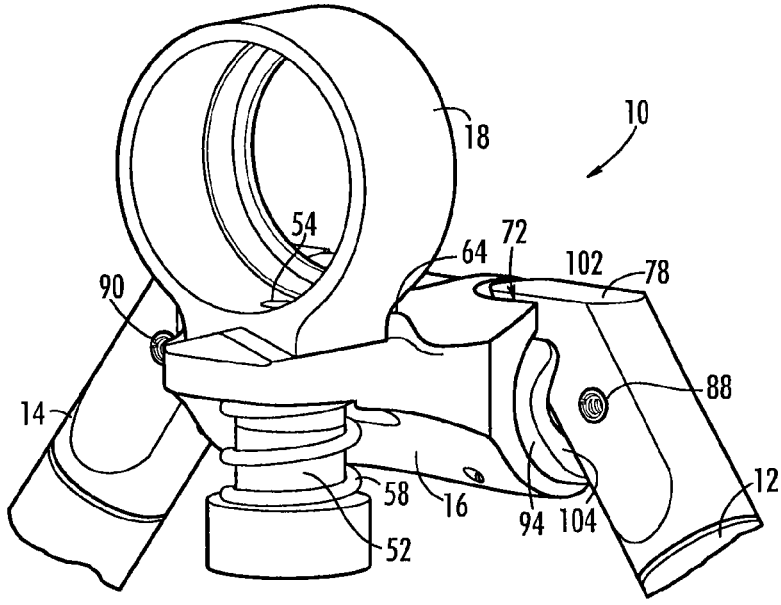
FIG. 5 is a detailed, perspective, top view of the bipod yoke.

FIG. 3B illustrates bipod 10 with legs 12, 14 oriented with respect to yoke 18 so that legs 12, 14 will spring into the deployed position in which they are splayed, as indicated by the arrows in FIG. 3B, and perpendicular to that of their stored position, as shown in FIG. 5.

FIG. 4 illustrates bipod 10 with yoke 18 oriented in the second of two stored positions. When bipod 10 is mounted to the barrel of a gun so that the barrel is pointed to the left, legs 12, 14, will extend away from but again parallel to the barrel. The machine gun is able to fire when legs 12, 14, are in any of these three orientations.

In use, bipod 10 is mounted to a machine gun and, if not already in one of the two stored positions, is placed in either stored positions by first pushing legs 12, 14, together so that they are parallel. Then legs 12, 14, can be rotated while held in parallel to either the position shown in FIG. 3A or 4 from that shown in FIG. 3B.

To deploy bipod 10, either leg 12, 14, can be grasped and rotated 90° toward the ground from either stored position. As leg 12 or 14 reaches the 90° point, compression spring 92 will force plungers 94 laterally and push legs 12, 14, outward at feet 22, 24. The user can then grasp either foot 22, 24, of legs, 12, 14, and pull to extend the length of that leg. At intervals along the length of legs 12, 14 as they are being telescopingly extended, buttons 44, 46, on rods 34, 36, will come into registration with holes 48, 50 in tubes 38, 40, so that they will extend through holes 48, 50. If feet 22, 24, are pulled farther, buttons 44, 46, will be crammed into rods 34, 36, by tubes 38, 40, to allow additional length, until the desired lengths for legs 12, 14, are reached and buttons 44, 46, have again come into registration with another set of holes 48, 50.

Once bipod 10 is in the deployed position, the machine gun on which it is mounted can be placed in position and the gunner can check his or her field of fire by rotating yoke 18 through the angle permitted by ledges 64 on body 16. He can also rotate the machine gun axially through the angle permitted by ledges 110 on yoke 18.

It will be readily apparent to those skilled in the art of firearm accessory design and fabrication that many changes and substitutions can be made to the foregoing preferred embodiments without departing from the spirit and scope of the present invention, defined by the appended claims.

What is claimed is:

1. A bipod for use with a firearm, said bipod comprising:
(a) a hollow body with a hole formed therein;
(b) a pair of legs pivotally attached to said hollow body, said legs having a stored position and a deployed position;
(c) a ring-shaped yoke formed to mount a firearm barrel, said yoke having a threaded hole formed therein;
(d) a stepped screw dimensioned to fit through said hole in said hollow body and be threadably received into said threaded hole in said yoke;
(e) a compression spring held between said hollow body and said stepped screw, said compression spring being placed over said stepped screw, said stepped screw compressing said compression spring when threaded into said hole in said yoke through said hole in said hollow body; and
(f) urging means carried by said body and connecting said legs so that when a first leg of said pair of legs is pivoted with respect to said body between said stored and said deployed positions, said urging means pivots said second leg with said first leg.

2. The bipod as recited in claim 1, wherein said legs have ground-engaging feet, said feet having a surface area at least 11 square centimeters.

3. The bipod as recited in claim 1, wherein said pair of legs is pivotally attached to said hollow body with a pivot pin, said pivot pin including a first cylinder and a second cylinder, said first cylinder being inside said second cylinder.

4. The bipod as recited in claim 3, wherein said first cylinder is a coil.

5. The bipod as recited in claim 3, wherein said second cylinder has a slit formed therein.

6. The bipod as recited in claim 3, wherein said first and said second cylinders have slits and said slit in said first cylinder being oriented approximately 180° from said slit in said second cylinder.

7. The bipod as recited in claim 1, further comprising a thread locking compound to retain said spring in said yoke.

8. A bipod for use with a firearm, said bipod comprising:
(c) a hollow body with a hole formed therein;
(b) a ring-shaped yoke pivotally carried by said body and formed to mount to a firearm barrel, said yoke having a threaded hole formed therein;
(c) a first leg having a first end and an opposing second end;
(d) a second leg having a first end and a second end, said first and said second legs having a stored position and a deployed position;
(e) means carried by said body for connecting said first leg to said second leg so that pivoting said first leg pivots said second leg;

(f) a stepped screw dimensioned to fit through said hole in said hollow body and be threadably received by said threaded hole in said yoke;

(g) a compression spring held between said hollow body and said stepped screw, said compression spring being placed over said stepped screw, said stepped screw compressing said compression spring when threaded into said hole in said yoke through said hole in said hollow body; and (g) urging means carried by said body and in operational connection with said legs so that when a first leg is pivoted with respect to said body from said stored to said deployed positions, said urging means splays said first and said second legs.

9. The bipod as recited in claim 8, wherein said legs have ground-engaging feet, said feet having a surface area at least 11 square centimeters.

10. The bipod as recited in claim 8, wherein said pair of legs is pivotally attached to said hollow body with a pivot pin, said pivot pin including a first cylinder and a second cylinder, said first cylinder being inside said second cylinder.

11. The bipod as recited in claim 10, wherein said first cylinder is a coil.

12. The bipod as recited in claim 10, wherein said second cylinder has a slit formed therein.

13. The bipod as recited in claim 10, wherein said first and said second cylinders have slits and said slit in said first cylinder being oriented approximately 180° from said slit in said second cylinder.

* * * * *